United States Patent [19]

Paton et al.

[11] Patent Number: 4,884,625

[45] Date of Patent: Dec. 5, 1989

[54] METHOD OF THE PLASMA JET REMELTING OF A SURFACE LAYER OF A FLAT METAL WORK HAVING PARALLEL SIDE EDGES AND APPARATUS FOR CARRYING OUT THE METHOD

[76] Inventors: Boris E. Paton, ulitsa Chkalova, 41-a, kv. 26; Jury V. Latash, ulitsa Artema, 55, kv. 23; Gennady F. Torkhov, ulitsa Prazhskaya, 3, kv. 456; Nikolai V. Reida, ulitsa Sapernoe pole, 26, kv. 59; Alfred I. Bukalo, ulitsa Petra Zaporozhtsa, 8/2, kv. 69; Vladimir K. Kedrin, ulitsa Sevastopolskaya, 1/1, kv. 35; Gary A. Melnik, ulitsa Prazhskaya, 3, kv. 169, all of, Kiev; Igor S. Pryanishnikov, ulitsa Koreshkova, 15, kv. 5, Elektrostal; Konstantin S. Tolstopyatov, ulitsa Lenina, 7, kv. 21, Elektrostal; Lev R. Tager, prospekt Lenina, 35a, kv. 35, Elektrostal; Mikhail M. Kljuev, ulitsa Mira, 2, kv. 77, Elektrostal; Jury I. Modelkin, prospekt Juzhny, 11, korpus 3, kv. 54, Elektrostal; Boris P. Sokolkin, prospekt Lenina, 10, kv. 88; Alexei K. Andrianov, ulitsa Khokhryakova, 21, kv. 56, both of, Sverdlovsk; Valentin V. Topilin, deceased, late of Elektrostal; by Tatyana V. Topilina, administrator, ulitsa Mira, 6, kv. 29, Elektrostal; Sergei G. Guschin, deceased, late of Sverdlovsk; by Alevtina V. Guschina, administrator, ulitsa Sheinkmana, 45, kv. 148, Sverdlovsk; by Ljudmila S. Korobkova, administrator, ulitsa Sheinkmana, 45, kv. 148, Sverdlovsk; by Tatyana S. Kuznetsova, administrator, ulitsa Sheinkmana, 45, kv. 148, Sverdlovsk, all of U.S.S.R.

[21] Appl. No.: 643,110

[22] Filed: Aug. 22, 1984

Related U.S. Application Data

[63] Continuation of Ser. No. 339,418, Jan. 15, 1982, abandoned.

[51] Int. Cl.[4] ..... B22D 27/02

[52] U.S. Cl. ..... 164/495; 164/496; 164/508

[58] Field of Search ..... 164/469, 470, 495–497, 164/508, 509, 514, 515

[56] References Cited

U.S. PATENT DOCUMENTS

| | | | |
|---|---|---|---|
| 2,525,133 | 10/1950 | Hopkins | 164/496 |
| 2,881,489 | 4/1959 | Mullaney et al. | 164/495 |
| 3,820,586 | 6/1974 | Takei | 164/508 |

FOREIGN PATENT DOCUMENTS

| | | | |
|---|---|---|---|
| 2121439 | 1/1972 | Fed. Rep. of Germany . | |
| 1579039 | 8/1969 | France . | |
| 2096550 | 1/1972 | France . | |
| 324863 | 6/1970 | U.S.S.R. . | |
| 1170668 | 11/1969 | United Kingdom | 164/497 |
| 1202192 | 8/1970 | United Kingdom | 164/497 |
| 1305671 | 2/1973 | United Kingdom . | |

OTHER PUBLICATIONS

Plasma Welding, Moscow, Metallurgia Publishers, 1968, p. 180, G. Farnasov, et al.

Journal of the Electrochemical Society, v. 107, pp. 36–38, 1960, C. S. Stokes.

*Primary Examiner*—Kuang Y. Lin

*Attorney, Agent, or Firm*—Lilling & Greenspan

[57] ABSTRACT

The method consists in that a flat work in an initial position is oriented horizontally between cooled mold beams. Plasma torches are arranged in line across the parallel side edges so that the anode spots of the extreme torches are confined by said edges of the work. By supplying a plasma forming gas and electric current to the plasma torches the work is heated with the formation of a metal pool which extends across the work from edge to edge. By relatively moving the work and the plasma torches in a horizontal plane and along the edges of the work movement of the metal pool over the sur- (Abstract continued on next page.)

face thereof is effected and thereby a remelted layer as thick as the pool is deep, is obtained. The apparatus for carrying out the method comprises a sealed chamber containing a mold having two beams arranged in a horizontal plane and being parallel to one another. Installed in the chamber are plasma torches mounted on shafts and connected through supply lines with the sources of plasma forming gas, electric current and cooling water. Each of the shafts is journalled in a sealing bush installed in the wall of the sealed chamber so that the axis of the shaft is parallel to the beams. Each shaft is rotatively driven by a drive. The apparatus further comprises a drive for relatively moving the work and the shafts in the plane parallel to the beams, connected with at least one of the elements taking part in such movement. The practice of the method with the help of the apparatus of the invention permits a high-quality work of a predetermined macrostructure of a surface layer, to be produced at a higher rate of treatment.

16 Claims, 8 Drawing Sheets

METHOD OF THE PLASMA JET REMELTING OF A SURFACE LAYER OF A FLAT METAL WORK HAVING PARALLEL SIDE EDGES AND APPARATUS FOR CARRYING OUT THE METHOD

This is a continuation of co-pending application Ser. No. 339,418 filed on Jan. 15, 1982, now abandoned.

BACKGROUND OF THE INVENTION

1. Field of the Invention

The present invention relates to electrometallurgy, particularly to plasma metallurgy and more specifically it pertains to a technique of the plasma jet remelting of a surface layer of a flat metal work having parallel side edges as well as to an apparatus for carrying out the remelting process.

The term "flat work having parallel side edges" means herein a work having at least one flat surface bounded by two parallel lines. Following this definition, a prismatic work of a rectangular cross-section or a semicylindrical work each will be termed a flat work.

2. Description of the Prior Art

Metallurgical semi-products, specifically those produced by continuous casting of metals, are known to have in their surface layer various defects such as cracks, blisters, peeling, coarse non-metallic inclusions, scale and so on.

Therefore a work, prior to the next process step, i.e. plastic deformation, e.g. rolling, is subjected to machining with the aim of removing a defective surface layer.

Such machining usually includes milling, planing, and removing the surface layer by means of abrasives, which results in a considerable wastage of metal (up to 30%).

Reprocessing of such waste metal, e.g. chips, by compacting and consequent remelting involves extra time and cost. The metal wastage therewith is still rather high.

The metal wastage becomes particularly appreciable when costly materials are involved. Furthermore, rapid wear of cutting tools is evident in machining hard alloys, which results in a lower efficiency of labor and a higher cost of the process.

It is to be noted that machining, as a surface defect removing technique, is a prolonged procedure. A low efficiency of labor is the result.

It might be well to emphasize that use of such technique at iron and steel works requires an extensive floor space to install roughing and dressing machines.

As compared with the mechanical elimination of defects in the surface layer of a work, a method of refining this layer which consists in the plasma jet remelting of this layer proves to be more efficient. This technique provides for the complete elimination of defects in the surface layer of a work for practically all purposes with a minimum metal wastage. This treatment results in a higher density of the work metal, lower contents of gas entrapments and non-metallic inclusions.

Known in the art is a method of plasma jet remelting of a surface layer of a metal work which is specifically a flat work having parallel side edges as disclosed in British Pat. No. 1,305,671, Cl. C7D, published in 1973, French Pat. No. 2,096,550, Int.Cl. C22d 7/00, published in 1974, and FRG Pat. No. 2,121,439, Int.Cl. C21c 5/52, published in 1975. This method includes forming a metal pool on a flat work positioned in a mold by heating the work through the use of plasma torches supplied with a plasma forming gas and electric current, while relatively moving the work and the plasma torches along the parallel edges of the work.

In accordance with the method a prismatic work of a rectangular cross-section is positioned, in the starting position, vertically in a mold so that the mold encloses on the work around the whole profile thereof.

The plasma torches are arranged around the work in the plane of the profile thereof so that each plasma torch faces a respective face of the work.

The work is placed on a starting plate and, as the periphery of the work is remelted by means of the plasma torches, is vertically drawn through the mold. In the process of remelting the level of the metal pool formed for each face of the work, is perpendicular to the surface being treated.

Hereinabove described method of the plasma jet remelting of a surface layer of a flat metal work having parallel side edges may be practiced by the use of an apparatus disclosed in British Pat. No. 1,237,115, Cl. B3F, published in 1971, and French Pat. No. 1,579,039, B22d 11/00 published in 1969.

This apparatus comprises a sealed chamber with a mold adapted to receive a work and plasma torches arranged within the chamber and through supply lines connected with sources of a plasma forming gas, electric current, and cooling water.

The mold of said apparatus has a form of a rectangular frame enclosing on the work around the periphery thereof. The opposing members of the frame are two cooled beams lying in a horizontal plane and being parallel to one another.

Mounted between the beams of the mold is a starting plate adapted to withdraw the ingot as it is formed from the work.

The plasma torches are arranged within the sealed chamber partially, i.e. only nozzle portions thereof are within the chamber, and are fixed in relation to this chamber.

The practice of the above-described method through the use of the above apparatus presents some difficulties, which are as follows.

According to the prior art technique the remelted surface is formed by contact thereof with the cooled mold. In doing this, some coarse defects are apt to appear in the macrostructure of the remelted layer, e.g. lateral cracks and longitudinal porosity.

It will be noted that the metal at the surface of the work is maintained liquid simultaneously with an intensive cooling action of the mold surrounding the metal pool around the work. In this case, if a relatively shallow metal pool is to be maintained in an effort to remelt the surface layer corresponding to the thickness of a defective layer, the metal pool will partially solidify thus forming several pools subjected to the action of the plasma torches and divided by solidified metal.

In a further drawing of the work through the mold, non-remelted portions of metal containing the defective layer will remain on the work surface. Consequent deformation of such work will reveal the defects of its surface layer and the work will be rejected.

Therefore the surface layer is to be remelted to a depth of 5 to 10 thicknesses of the defective layer. This results in overexpenditure of electric power and the plasma forming gas, as well as in decreased efficiency and an increased cost of the plasma jet remelting process.

In remelting the surface layer of a work according to the prior art technique, liquid metal solidifies in such a manner that the axes of pulled crystals in the layer are directed to the ingot surface at a substantially right angle. Such macrostructure of the surface layer remains even in the case of varying the power of the plasma torches and the speed of withdrawing the work.

Such macrostructure is responsible for deteriorations of plastic properties of the metal. Further deformation of the work involves crack formation between the pulled crystals, since the direction of the deformation force and the orientation of the axes of these crystals coincide.

It is also well to emphasize that according to the prior art method the thickness of the remelted layer of the work is determined by the width of the metal pool on the surface of the work. The level of the pool is not a practical measure for determining the thickness of the remelted layer.

That is why an effort to intensify the process of metal refining by widening the metal pool results in a deeper melting of the work and thus in a higher consumption of electric power and the plasma forming gas.

On the other hand, an increase in productivity of the treatment through raising the speed of withdrawing the work from the mold results in a poor surface of the work thus formed. This is caused since an increase in the speed of withdrawing the work with the thickness of the layer remelted being unchanged (which is attainable through an increase in the plasma torch power) results in the metal pool elongation in the direction of the work movement. In this case the solidification front acquires the form of a wedge. The crystal growth is directed from the wedge faces to the axis of the wedge. The crystal growth from the opposite directions involves, in a solidified work, porosity formation along the wedge axis and impairs the quality of the work surface layer.

For the reasons hereinabove stated the prior art technique provides for the production of the work with a remelted layer of an adequate quality and a thickness at least sufficient to eliminate defects in the initial layer only at a relatively low productivity which does not meet the requirements of the present-day metallurgical production. Actually the rate of withdrawal of the work from the mold is under 20 mm/min.

It is to be also noted that an effort to control the thickness of the layer being remelted by controlling the pool level through the variably rated plasma torches yields no substantial results, since the metal pool level is not controlling the thickness of the layer.

And finally, reference should be made to the fact that the practice of the above method on the prior art apparatus reveals instability of the plasma jet remelting, i.e. the pool level fluctuates in the mold and the overfilling of the mold is likely to occur. Some amount of metal is therewith often transferred as drops from the surface being remelted to the pool through the plasma arc.

Drops of liquid metal that get into the plasma arc impair the arc stability and get splashed away which results in loss of metal and poor surface of the work.

SUMMARY OF THE INVENTION

The object of the invention is to provide a method of plasma jet remelting of a surface layer of a flat metal work having parallel side edges and an apparatus for carrying out the method, which by varying the location of plasma torches and the work in the starting position as well as by varying the plane of their relative movement in the course of remelting process make it possible to obtain a work with a high-quality remelted surface layer of a predetermined thickness and macrostructure with a high rate of treatment.

This object is attained by providing a method of the plasma jet remelting of a surface layer of a flat metal work having parallel side edges, said method comprising forming a metal pool on the work positioned in a mold, by heating the work through the use of stabilized arcs supplied with a plasma forming gas and electric current while relatively moving the work and plasma torches along the parallel edges of the work, wherein, according to the invention, the work in its starting position is positioned horizontally in the mold and the plasma torches are arranged in line under the work and across the parallel edges thereof so that the anode spots of the extreme torches in the line are confined between said edges of the work for forming the metal pool of a length equal to the distance between these edges and in the process of remelting relative movement between the work and the plasma torches is in a horizontal plane for producing, over the work surface, a remelted layer of a thickness equal to the metal pool depth as the pool level moves on the work surface.

In the process of remelting a surface of a work as above the surface being treated is not in contact with the molding surface and the metal pool level is coplanar with the surface being treated.

Thereby the molten metal surface is shaped freely, being out of contact with the molding surface and clear of mechanical action on the part thereof. In free forming of a molten surface the quality of the surface layer of a work is improved and higher rate of treatment becomes possible through a higher relative speed between the work and the plasma torches since the magnitude of the speed under such conditions is not controlling the quality of the surface shaped.

Thanks to the horizontal position of the work there is no need to confine the metal pool by the cooled walls of the mold through the cross-section of the work, thereby the area of contact between the mold and the metal pool is reduced. In this case dissipation of heat from the molten metal is not so much as heat transfer through the molding surface, but as convective and radiation heat transfer from the surface being freely shaped while the mold is mainly a holder of the molten metal on the work surface.

Resistance forces arising from the movement of the work relative to the mold are lowered and probability of crack initiation in the surface layer of the work gets decreased. Also, the mold design is less sophisticated.

The plasma torches arranged in line over the work as hereinabove described make it possible to maintain the metal pool long enough to extend between the side edges of the work and to distribute the plasma torches according to their power as desired along the pool length. This provides for control of the shape of both the pool melting front and the solidification front thereof and thus pre-assignment of a desired macrostructure of the surface layer of a work.

As the work is moved in relation to the plasma torches in a horizontal plane the pool level continually moves on the work surface. This ensures such macrostructure wherein the axes of the pulled crystals are parallel to the surface treated. A work of such macrostructure has improved plastic properties which is of particular value for subsequent deformation of the work.

In the practice of the method of the invention the solidification front is undirectional, i.e. crystal growth from the side and bottom portions of the pool takes place in only one direction, namely, to the surface of the pool. This prevents shrinkage porosity in the metal and greatly improves the surface layer of the work.

Furthermore, according to this method the pool depth is controlling the thickness of the remelted layer of the work. This permits the thickness of the remelted layer of the work to be controlled over a wide range by varying the pool depth through a proper ratio between the rating of the plasma torches and the relative speed of the work and said torches. Thereby it becomes possible to melt the work to a depth least sufficient to eliminate defects in the initial surface layer and thus cut down the consumption of electric power and the plasma forming gas.

The relative speed of the work and the plasma torches movable in a horizontal plane is preferably in the range of 3 to 500 mm per minute.

The speed within the range is an optimum and provides for a high-quality surface of the work with a dense macrostructure.

Should the speed be less than 3 mm per minute the efficiency of the process will be relatively low and therefore not conforming to the requirements of present-day metallurgical production.

Once the speed is higher than 500 mm per minute maintenance of the pool between the side edges of the work is difficult.

The number of the plasma torches in said line is desirably a multiple of three and a three-phase current applied to these torches.

When the plasma torches are supplied with the three-phase current simpler sources of supply are required as compared with those for a direct current. This cuts down expenses on the practice of the method.

It is worth while oscillating at least a part of plasma torches of said line in a plane lateral to the direction of relative movement between the work and the plasma torches.

This gives uniform melting of the surface layer of the work and stirring the metal pool in the process of remelting due to a mechanical action of the fluctuating plasma arcs on the pool.

Also, it is possible to cut down the number of plasma torches in said line since the torch fluctuations increase the heated area.

For best results the plasma torches are oscillated from 10 to 100 times per minute.

Such range of frequencies provides the best conditions for maintaining the metal pool.

Should the frequency be lower than 10 oscillations per minute, there may occur some unmelted area portions on the surface of the work due to a relatively high speed of movement of the pool over the surface.

Then, the frequency of more than 100 oscillations per minute may at times result in splashing of the metal. The quality of the surface being formed is thus deteriorated.

The oscillations in the plane defined hereinabove may specifically be imparted to the intermediates of said line of the torches, while the extreme torches of the line be fixed in said plane.

This modification of the method improves the side edges of the surface remelted. It is useful in working the metals and alloys of high thermal conductivity, e.g. copper, gold, and platinum. In this case an intensive dissipation of heat at the edges of the work due to its high thermal conductivity does not affect the stability of the remelting process.

The extreme torches from said line are preferably supplied with a direct current, while the intermediate torches from the line are supplied with an alternating current.

The DC supply for the extreme torches permits the best orientation of the plasma arcs of these torches relative to the edges of the work since the anode spot of a DC arc is practically immovable on the target surface which provides for a high stability of the process of remelting the edges. But the AC supply for each intermediate torch makes the plasma arc fluctuate, which involves greater amplitude in the plasma arc fluctuations at an invariable frequency of the torch oscillations. This brings an increase in the mechanical action of the arc on the metal pool and further widens the range of heating produced by each oscillating torch.

The object of the invention is also attained by that in an apparatus for the plasma jet remelting of a surface layer of a flat metal work having parallel side edges, said apparatus comprising a sealed chamber with a mold adapted to receive a work and having two cooled mold walls lying in a horizontal plane and being parallel to one another, plasma torches arranged within the chamber and through supply lines connected with sources of a plasma forming gas, electric current, and cooling water, according to the invention, the plasma torches are mounted on shafts within the chamber, each shaft is journalled in a sealing bush installed in the wall of the chamber so that the axis of each shaft is parallel with the molding walls and each shaft is provided with a drive for rotating the same about its axis, the apparatus being provided with a drive for relatively moving the work and the shafts in a plane parallel with the walls of the mold along the axes of the shafts, connected to at least one of the associated elements.

The plasma torches mounted on the driven shafts having axes thereof parallel with the walls of the mold and the drive for relatively moving the work and the shafts in a plane parallel with the walls of the mold along the axes of the shafts provide for the practice of the plasma jet remelting of a surface layer of a work according to the method of the invention and thereby a work with a high-quality surface layer of a specified thickness and macrostructure can be produced along at a high rate of treatment.

It is imperative that the shaft of each plasma torch have an axial bore containing supply lines for the torch.

Such arrangement makes the apparatus more dependable and serviceable.

The simplest in design is a modification of the apparatus according to which the walls of the mold are secured on a truck movably mounted within the sealed chamber while the drive for relatively moving the work and said shafts carrying the plasma torches is a translatory drive connected with the truck for simultaneously moving the walls of the mold and the work in respect to the shafts carrying the plasma torches.

Such modification of the apparatus is useful in the plasma jet treatment of a relatively short workpieces (up to 1000 mm) of a small thickness (up to 100 mm) on a 1 kA current. The limits on the thickness of a work and on the current magnitude are due to the known difficulties in supplying current to the work and with said truck such supply should be moving.

The drive for relatively moving the work and the shafts carrying the plasma torches may be constructed as a translatory drive connected with the shafts, while the walls of the mold may be fixed in respect to the sealed chamber and the work.

With the shafts being provided with translatory drives while the mold walls are stationary the work when in a stationary position can be processed by the plasma jet technique which makes it possible to construct a shorter chamber that is a slight amount longer than the work itself. A stationary work requires a fixed contact bus bar, which enables the electric current used to be increased and thus thicker than hereinabove workpieces to be processed.

When the walls of the mold are stationary cooling water supply thereto is simpler.

An apparatus of such design is useful in the plasma jet processing of relatively thick workpieces (above 100 mm) on the 5 kA current.

It is advisable that the walls of the mold be fixed in respect to the sealed chamber, while the drive for relatively moving the work and the shafts carrying the plasma torches be shaped as rollers provided with a drive for rotatively moving the same and being in contact with the work for drawing the same between the walls of the mold.

Owing to the driven rollers drawing the work between the walls of the mold under the plasma torches, the metal pool formed thereby is practically immovable in relation to the mold walls. This makes it possible to substantially reduce the length of the cooled mold walls and to bring it up to only 1.5 to 2 times the desired width of the metal pools.

This modification is useful in the plasma jet processing of relatively long workpieces (over 1000 mm) and 100 mm in thickness. This modification is conveniently supplied with an alternating current, since there is no need of current supply to the workpiece.

It is equally possible to interconnect the shafts carrying the plasma torches and the walls of the mold by a gantry movably mounted within the sealed chamber, while the drive for relatively moving the work and the shafts carrying the torches to make as a translatory drive connected with the gantry for simultaneously moving the shafts carrying the torches and the walls of the mold in respect to the work.

The gantry connecting the shafts with the plasma torches and the walls of the mold to make an assembly movable in relation to the stationary work, affords as in a previous modification the metal pool immovable in relation to the walls and thereby makes it possible to reduce their length.

This arrangement is applicable in the plasma jet processing of the workpieces of over 1000 mm in length and over 100 mm thick. Such modification is convenient for a DC supply owing to the fact that the work is immovable in the process of remelting.

BRIEF DESCRIPTION OF DRAWINGS

The nature of the present invention will be clear from the following description of several embodiments thereof, taken in conjunction with the accompanying drawings in which.

DESCRIPTION OF THE PREFERRED EMBODIMENTS

Figure 1:
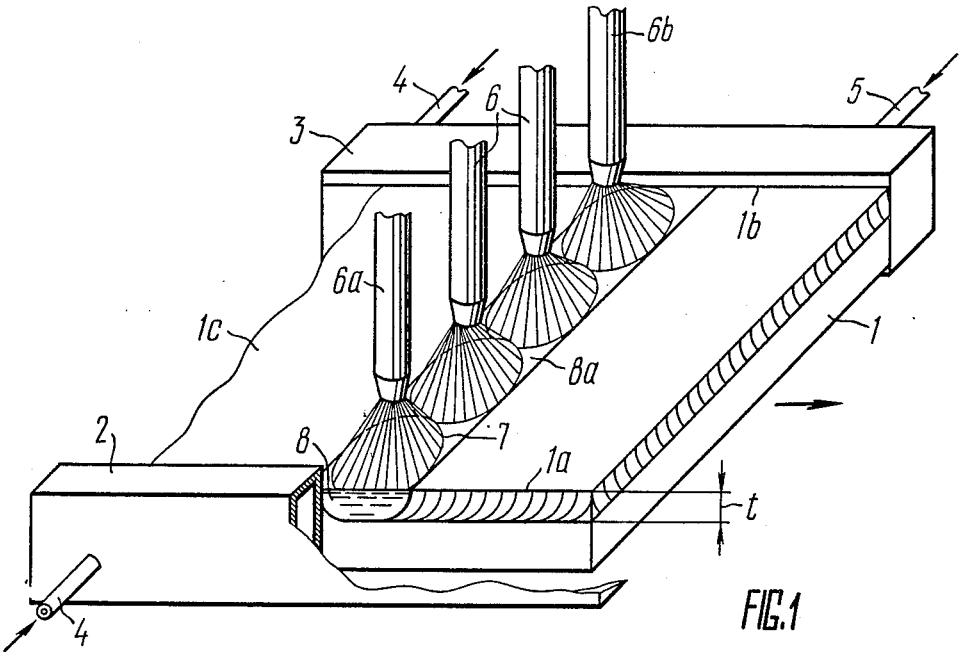
FIG. 1 is a diagrammatic perspective view illustrating the manner of carrying out the method of the plasma jet remelting of a surface layer of a flat metal work having parallel side edges (the arrow shows the direction of movement of the work)

The method of the invention for the plasma jet remelting of a surface layer of a flat metal work having parallel side edges, will now be described.

In the initial position a flat metal work 1 (FIG. 1) having parallel side edges 1*a* and 1*b* and herein shaped as a right parallelepiped, is positioned horizontally in a mold comprising two cooled walls 2 and 3 lying in a horizontal plane and parallel to one another. Cooling water is supplied to the walls 2 and 3 through pipes 4 and drawn off through pipes 5 (for the sake of simplicity one of the draw-off pipes is not shown).

Above the work 1 vertically in line and across the parallel edges 1*a* and 1*b* are mounted plasma torches 6 so that the anode spots 7 of the extreme torches 6*a* and 6*b* in the line are confined between the edges 1*a* and 1*b* of the work 1.

By supplying all the plasma torches 6 with a plasma forming gas, for example argon, and a stabilized electric current plasma arcs are ignited between the end faces of the torches and the surface 1*c* of the work 1.

Heating the work 1 as above, a metal pool 8 is formed on the surface 1*c* at one of the margins thereof (a right hand margin in the drawing). The length of the metal pool 8 is the same as the distance between the side edges 1*a* and 1*b* of the work 1 or in other words, is equal to the width of the latter. Molten metal on the surface of the work 1 is held and consequently solidified by the beams 2 and 3.

Figure 2:
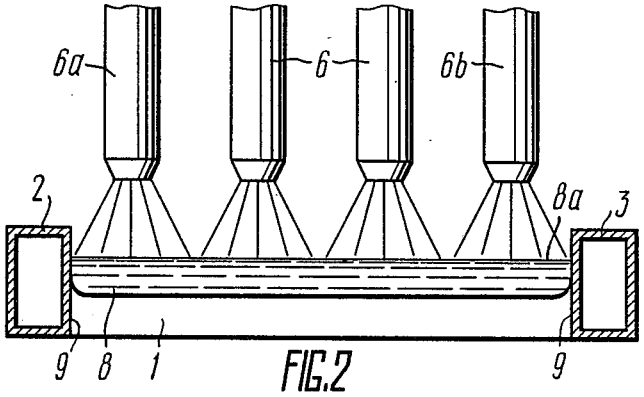
FIG. 2 is a right side view of an apparatus according to the present invention.

It is to be noted that the level 8*a* of the pool 8 lies in the same plane as the surface 1*c* of the work 1, and the molding surface 9 of each wall 2 or 3 of the mold is perpendicular to the surface 1*c* of the work 1 and is out of contact with the surface as is best seen in FIG. 2. This offers favorable conditions for solidification of the metal and formation of a high-quality surface.

Following the formation of the pool 8 of a predetermined depth on the surface 1*c* of the work 1, i.e. the pool controlling the thickness t of the layer to be remelted (FIG. 1), the work 1 and the plasma torches 6 are relatively moved in a horizontal plane along the edges 1*a* and 1*b* of the work 1.

Such relative movement is effected, e.g. by moving the work 1 in the direction as indicated by the arrow in FIG. 1. It is evident that another way is possible, i.e. to move the plasma torches 6 above the stationary work 1 in a reverse direction.

As the level 8*a* of the pool 8 is moved over the surface 1*c* of the work 1 in the reverse direction in relation to the movement of the work 1 (to the left as indicated in the drawing) the latter is melted over the entire surface to a depth equal to that of fthe pool 8 and solidifies as a result of heat dissipation from the surface thereof by convection and radiation into atmosphere and by heat conduction through the molding surfaces 9 of the walls 2 and 3 of the mold.

In the process of remelting, defects in the surface layer are eliminated. The depth of the layer to be remelted is determined by the depth of defect occurence in a work.

The width of the pool 8, speed of movement of the work 1 and power of the plasma torches 6 are determined depending upon the work material and dimensions thereof. The speed of movement is also determined within the range of 3 to 500 mm per minute provided the pool is maintained stable and the productivity of the process is at a required level.

It is to be noted that since the work surface that is cooled (in contact with the molding surface 9 of the walls 2,3) is not coincident with the surface 1*c* that is formed (treated), in other words, separated from the surface 1*c*, a considerable increase in the productivity of the treatment is possible by an increase in the speed of the work movement and in doing this provide a high-quality surface.

At the final stage of the process when the level 8*a* of the pool 8 reaches the opposite (left) margin of the work 1, movement of the pool is ceased and by gradually decreasing the power of the plasma torches 6 a uniform solidification of the metal is provided at this location.

The depth of the pool 8 and consequently the thickness t of the surface layer remelted are controlled by varying the power of the plasma torches 6 and of the speed of movement of the work 1. With an increase in power and a decrease in the speed of movement of the work 1 the depth of the pool 8 is increased.

By varying the power of the plasma torches 6 in the line across the width of the work 1, the configuration of the solidification front as well as the melting front of the pool 8 is varied in order to obtain a required macrostructure of the remelted layer.

It will be understood by those skilled in the art that to remelt the surface of the work along the length thereof including the marginal portions it is imperative to stop the metal flow at these portions. With this end in view there are unmelted portions left at the right-hand margin of the work 1 (at the initial stage) and at the left-hand margin (at the final stage) or in addition to the walls 2 and 3 adjoining the edges 1*a* and 1*b* of the work 1, cooled walls may be further provided at the end edges of the work 1 (these beams are not shown in FIG. 1). In the latter case the mold will take the form of a cooled frame surrounding the work 1 along its periphery.

It is to be noted that the plasma torches may be supplied by either direct or alternating currents and particularly a three-phase current. It is evident that the latter supply affords simpler power source. When a three-phase AC supply is connected to the plasma torches 6 the number of the torches is to be a multiple of three and each group of three torches is to be connected to a separate three-phase AC supply.

Figure 3:
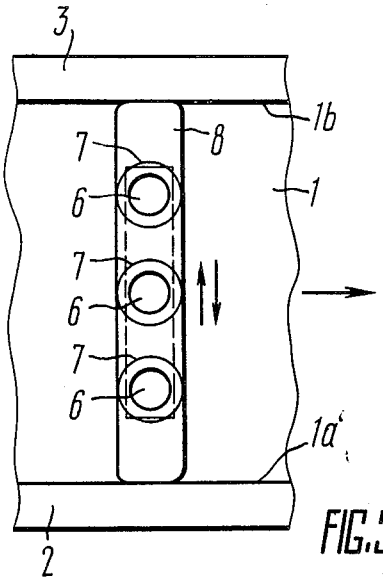
FIG. 3 is a top diagrammatic view illustrating a modified form of the invention wherein oscillations in the plane lateral to the direction of the work movement are initiated by plasma burning (the arrows show the directions of the oscillations of the plasma torches and of the work movement)

An alternative way to practice the method of the plasma jet remelting is to oscillate a part of the plasma torches 6 in the line or all of them in relation to the moving work 1 in a plane orthogonal or perpendicular to the direction of its movement (FIG. 3). Such modification enables the number of the plasma torches 6 in the line to be reduced.

Also, the oscillating plasma torches 6 provide for a uniform melting of the surface layer of the work 1 and for a better stirring of the molten metal in the pool 8 by a mechanical action on the pool on the part of the plasma torches.

To maintain the metal pool 8 at optimum conditions the plasma torches are oscillated at a frequency in the range of 10 to 100 oscillations per minute. The frequency of oscillations is dependent on the material of the work 1, the speed of movement of the work, on the power of the plasma torches 6 and the predetermined mactostructure of the remelted layer.

Figure 4:
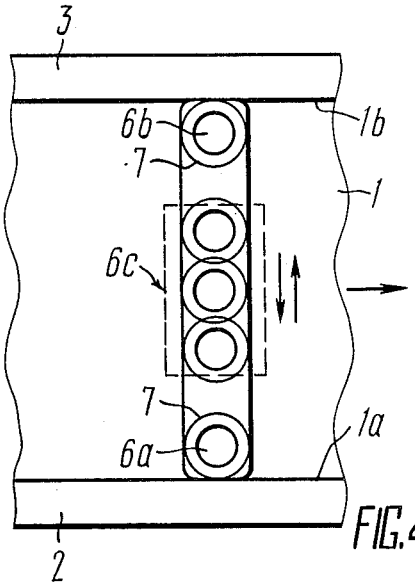
FIG. 4 is a top diagrammatic view illustrating a modified form of the invention wherein intermediate torches of said line are oscillated in the plane lateral to the direction of the work movement, while the extreme torches are fixed in the same plane (the intermediate torches are identified by rectangles in dotted lines)

Referring to FIG. 4 of the accompanying drawings, there may be a modified method wherein the oscillations in the plane referred to are imparted only to the intermediate or inner plasma torches 6*c* of the line, while the extreme or end torches 6*a* and 6*b* in the same line are immovable in the same plane.

This modification is useful in remelting works from copper, gold, platinum and other materials having a high heat conductivity. Due to the fact that the extreme plasma torches 6*a* and 6*b* are immovable, the side edges 1*a* and 1*b* have a well defined, regular form despite intensive heat removal in the vicinity of these edges.

To make the plasma arcs of the extreme torches 6*a* and 6*b* more reliably oriented at the edges 1*a* and 1*b*, these torches are supplied from a DC source, and the intermediate torches 6*c* are AC supplied to increase the amplitude of the plasma arc oscillations. Experimental results attest that the best melting of the surface of the work are with such combined electric supply. If such treatment should be given to the reverse side (in FIG. 1 the lower one) of the work 1, the latter is turned over and the process repeated.

It is to be appreciated that the modifications as hereinabove disclosed and illustrated in FIGS. 1 through 4 are not limiting the invention but serve as an illustration of the inventive concept only.

The method of the invention is practiced through the use of an apparatus for the plasma jet remelting of a surface layer of a flat metal work having parallel side edges, the apparatus being shown in FIGS. 5 through 12 of the accompanying drawings.

The apparatus (FIGS. 5 and 6) comprises a sealed chamber 11 mounted on a frame 10 and plasma torches 6 arranged within the chamber 11. The sealed chamber 11 allows treatment of the work 1 in a controlled atmosphere. Each plasma torch 6 is connected through supply lines 12, 13 and 14 with the sources of a plasma forming gas, electric current and cooling water respectively. (For simplicity reasons the sources are not shown).

The apparatus is also provided with a mold adapted to position the work 1 therein and comprising two water-cooled walls 2 and 3 similar to those of FIGS. 1 through 4. These walls are positioned in a horizontal plane and are parallel to one another. Furthermore, the mold is furnished with two more walls 15 and 16, together with the mold walls 2 and 3, making a frame surrounding the work 1 along its periphery.

According to the invention the plasma torches 6 (FIG. 5) are mounted on shafts 17. Each shaft 17 is journalled in a sealing bush 18 installed in the wall of the sealed chamber 11. The sealing bush 18 is installed in a sleeve 19 secured on the chamber with a sealing packing 20. The sleeve is covered with a cap 21.

Figure 6:
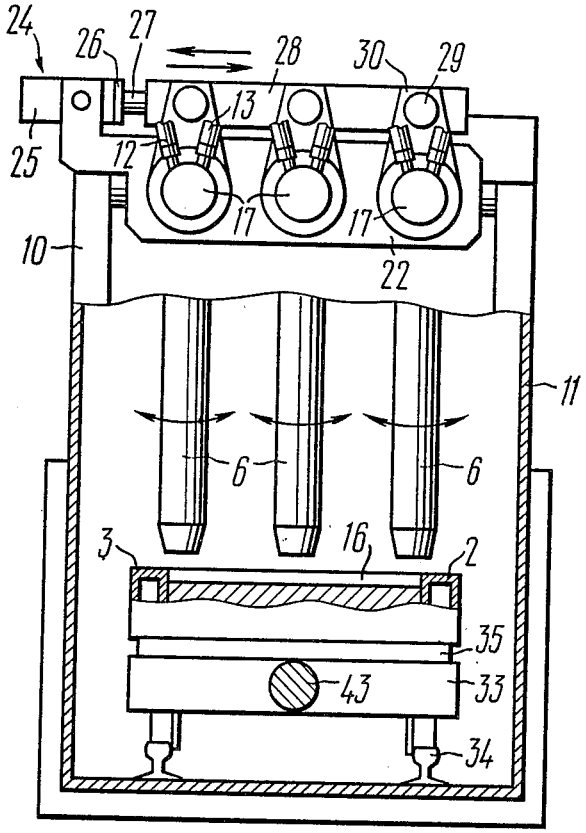
FIG. 6 is a left side view of the apparatus shown in FIG. 5.

Secured to the frame 10 is a beam 22 with sealing bushes 23 inserted in the holes made in the wall. Each shaft 17 extends through a corresponding bush 23 and is positioned so that its axis is parallel to the beams 2 and 3 of the mold (FIG. 6).

The shafts 17 are rotated from a common drive 24 which comprises a hydraulic cylinder 25, the piston 26 of which through piston rod 27 is connected to a cross-piece 28. The cross-piece 28 carries pins 29 the number of which corresponds to the number of shafts 17 (and consequently to the number of the plasma torches 6).

Each shaft 17 and a corresponding pin 29 are interconnecting with a link 30.

This arrangement provides for simultaneous angular movement of the links 30 on the shafts 17 under the action of the piston 26 of the cylinder 25 which imparts translatory movement to the cross-piece 28. The links 30 make the shafts 17 to turn and, consequently, to move the plasma torches in the same direction. In reversing the cross-piece 28 the shafts 17 and the plasma torches 6 turn and move in the opposite direction. Thus the plasma torches can be oscillated in a vertical plane as indicated by the arrows in FIG. 6.

It is evident that the plasma torches can be oscillated by individual drives as well as by drive 24 common for all the shafts 17.

To make the apparatus more dependable and serviceable each shaft 17 has an axial bore 31 containing supply lines 13, 14, and 15 for the torch. The axial bore 31 in the shaft 17 is sealed by means of a vacuum seal 32 disposed between the shaft end face and the plasma torch 6.

According to the invention the apparatus is provided with a drive for relatively moving the work 1 and the shafts 17 in the plane parallel to the walls 2 and 3 of the mold along the axes of these shafts. This drive may be optionally connected to either the work 1 or the shafts 17.

Figure 5:
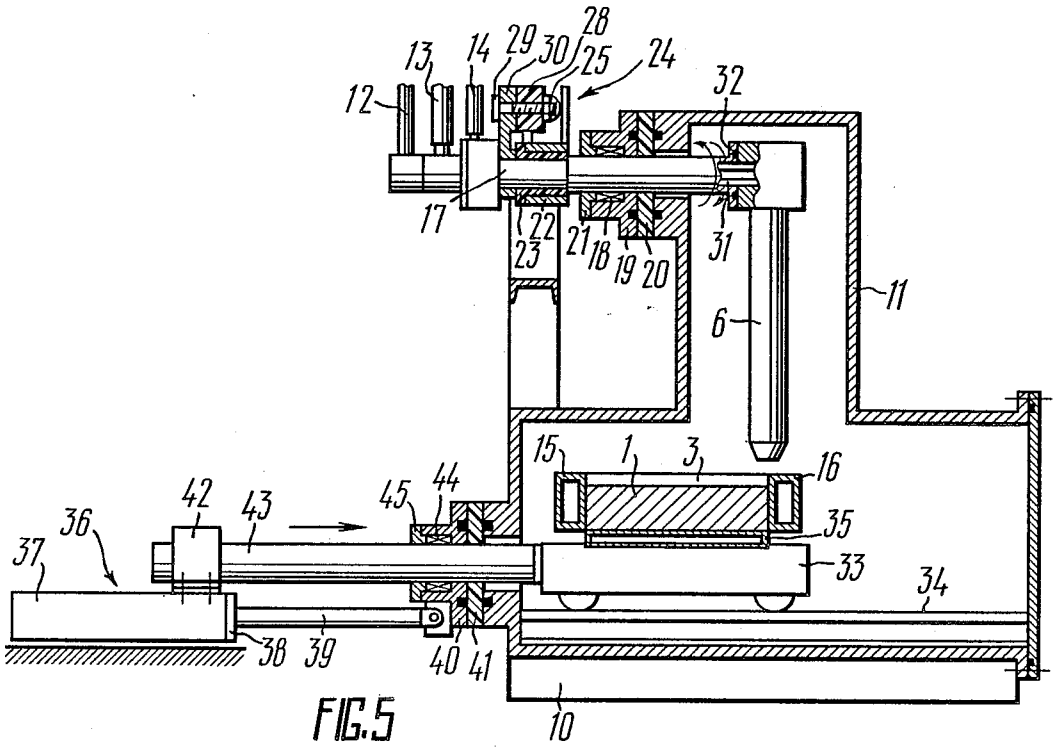
FIG. 5 is a cross-sectional view of a modified apparatus for carrying out the method of the invention, wherein the walls of the mold are secured on a driven truck.

Specifically this drive may be such as for moving the work in the plane specified as shown in FIGS. 5 and 6. To this end the walls 2, 3, 15 and 16 of the mold are secured on a truck 33 movably mounted in the sealed chamber 11 on a track 34. To improve conditions for solidification of the work 1 there is cooled bottom plate 35 supported on the truck 33.

The truck 33 (FIG. 5) is furnished with a translatory drive 36 exemplified herein as a hydraulic cylinder 37, the piston 38 of which together with the piston-rod 39 thereof is secured to the sleeve 40 attached with a packing 41 to the wall of the sealed chamber 11. The hydraulic cylinder 37 is mounted for movement to and from the frame 10 and the piston 38 in the direction shown by the arrow in FIG. 5 and is rigidly connected to the truck 33 through a bracket 42 and rod 43 extending through openings in the sleeve 40, the packing 41, and the wall of the sealed chamber 11. The sleeve 40 is sealed with a sealing bush 44 and covered with a cap 45.

An apparatus modified as above is functioning to carry out the method as follows. A work 1 is placed on the cooled bottom plate 35 between the beams 2, 3, 15 and 16 of the mold and maintain a controllable atmosphere within the chamber 11.

When a plasma forming gas is supplied through lines 12 and 13 to the plasma torches 6 as well as an electric current, a plasma arc appears between the end-faces of the torches and the work 1. To cool the nozzles of the plasma torches 6 water is supplied thereto through lines 14. If the plasma torches are operated on a DC supply then one of the poles of the current supply source is connected to the truck 33 via contact means (not shown).

After the metal pool has been formed across the width of the work 1 at one of its end edges (right-hand edge in FIG. 5) a pressure liquid is delivered into the hydraulic cylinder 37 thereby the truck 33 together with the work 1 is caused to move to the right. The work 1 is thus melted to a predetermined depth along the length thereof.

To carry out the modified method illustrated in FIGS. 3 and 4 the pressure liquid, as the work 1 moves, is delivered alternatively to the piston side and to the rod side of the hydraulic cylinder 25 thereby oscillating the plasma torches 6 in the plane lateral to the direction of movement of the work 1 as shown in FIG. 6.

The modified apparatus shown in FIGS. 5 and 6 is useful in the treatment of the workpieces up to 1000 mm long and 100 mm wide on a 1 kA current supply.

Figure 8:
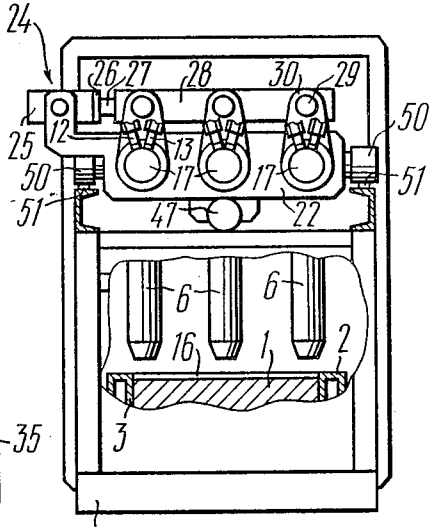
FIG. 8 is a left side view of the apparatus shown in FIG. 7.
Figure 7:
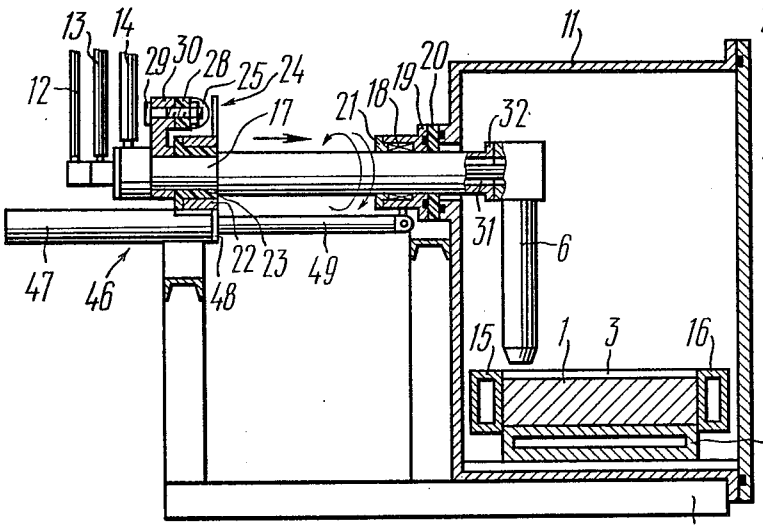
FIG. 7 is a cross-sectional view of an apparatus of the invention, illustrating a further modification wherein the shafts carrying the plasma torches are connected with a translatory drive, while the walls of the mold are fixed in relation to the sealed chamber and the work.

For wider workpieces (above 100 mm) and on high currents (up to 5 kA) the apparatus may preferably be constructed as shown in FIGS. 7 and 8.

In such modified apparatus the beams 2, 3, 15 and 16, the cooled bottom plate 35 and the work 1 are immovable in relation to the sealed chamber 11, while the shafts 17 are furnished apart from the rotary drive 24 with a translatory drive 46 moving the shafts along the axes thereof.

The drive 46 (FIG. 7) is a hydraulic cylinder 47, the piston 48 of whichis connected to the sleeve 19 via the piston-rod 49. In contrast to the modification shown in FIGS. 5 and 6 in the instant arrangement the wall 22 (FIG. 8) is provided with rollers 50 and is mounted on guideways 51 secured to the frame 10. The hydraulic cylinder 47 and the wall 22 are rigidly interconnected.

When the pressure liquid is delivered to the cylinder 47, the latter begins to move in relation to the piston-rod to the right as shown by the arrow in FIG. 7, and moves or pushes the beam 22 carrying the shafts 17 with the plasma torches 6. The plasma torches 6 are moved over the work 1 immovably supported underneath, and thus successively melting down the work along the length.

It is to be noted that this arrangement in contrast with the one hereinabove described affords a simpler water supply system to cool the mold. Moreover, when a DC supply is used to form the plasma, the contact means is simpler (not shown).

It is also important that in this modification of the apparatus of the invention the sealed chamber 11 is shorter, herein it is a slight amount longer than the work 1, while in the previous modification due to the work movement within the chamber the length of the latter cannot be shorter than two lengths of the work.

Figure 10:
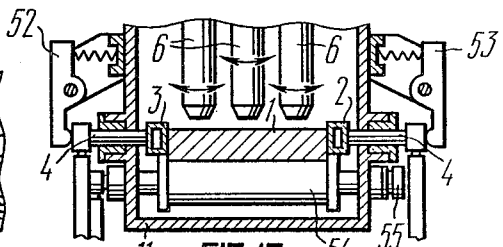
FIG. 10 is a sectional view of an apparatus of the invention taken along line X—X of FIG. 9.
Figure 9:
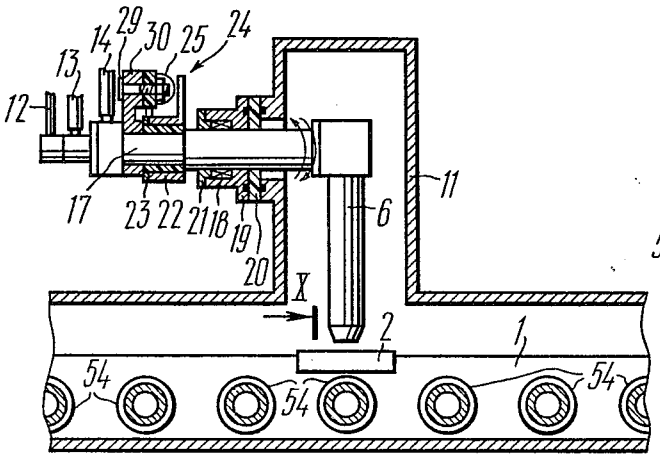
FIG. 9 is a cross-sectional view of an apparatus of the invention, illustrating a still further modification wherein there are rollers connected with a rotative drive and being in contact with the work for drawing the same between stationary walls of the mold.

The apparatus for carrying out the method of the invention for the plasma jet remelting of a surface layer of a flat metal work having parallel side edges, may be constructed as shown in FIGS. 9 and 10.

According to this embodiment the mold consists of two cooled beams 2 and 3 immovably secured within the sealed chamber 11 and arranged parallel to the shafts 17. Both the beams 2 and 3 are forced against the side edges of the work 1 by pressure means 52 and 53 (FIG. 10). The pressure means 52 and 53 may be of various designs known in the art and therefore are not described in detail. Cooling water is supplied to the beams 2 and 3 through the pipes 4.

To effect relative movement between the work 1 and the shafts 17 carrying the plasma torches 6 the apparatus of the invention comprises rollers 54 arranged under the mold walls 2 and 3 and composing a roller table as is seen in FIG. 9. The rollers 54 are furnished with a drive 55 (FIG. 10) for rotating thereof.

The work to be treated is placed on the roller table between the mold walls 2 and 3 so that there be a friction contact between the work and the rollers 54. On actuating the drive 55 the rotating rollers 54 draw the work 1 between the beams 2 and 3 thereby moving consecutive portions of the work 1 into the zone of action of the torches 6 to melt the surface of the work 1.

The metal pool 1 maintained on the surface of the work in this instance is practically immovable in relation to the mold walls 2 and 3. Since the beams 2 and 3 are mainly holding the molten metal on the surface of the work and since the pool is immovable in relation to the walls, it is possible to reduce the walls in length as compared with the same of the previously described modifications. For practical purposes the walls 2 and 3 of the mold arc 1.5 to 2 times as long as the predetermined width of the metal pool.

Shown in FIGS. 9 and 10 is a further modified apparatus of the invention, which is useful in the plasma jet treatment of relatively long workpieces of a small width (above 1000 mm long and 100 mm wide). To simplify the power supply for maintaining the plasma arc, it is practical to use an AC power source with such a modification.

Figure 11:
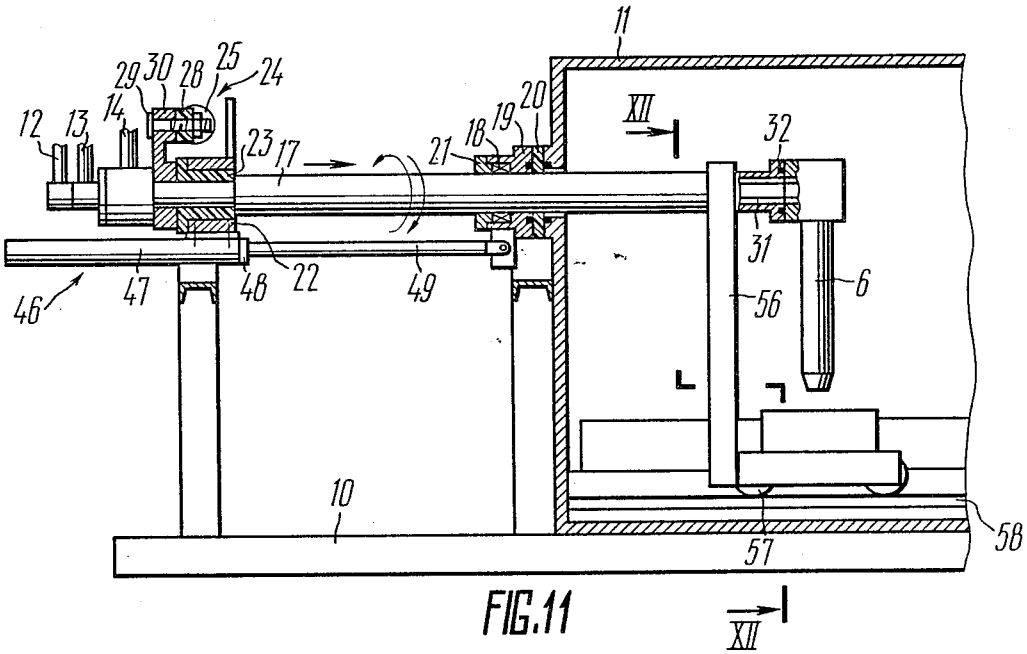
FIG. 11 is a cross-sectional view of an apparatus of the invention, illustrating an alternative modification wherein the shafts carrying the plasma torch and the walls of the mold are secured on a driven gantry.
Figure 12:
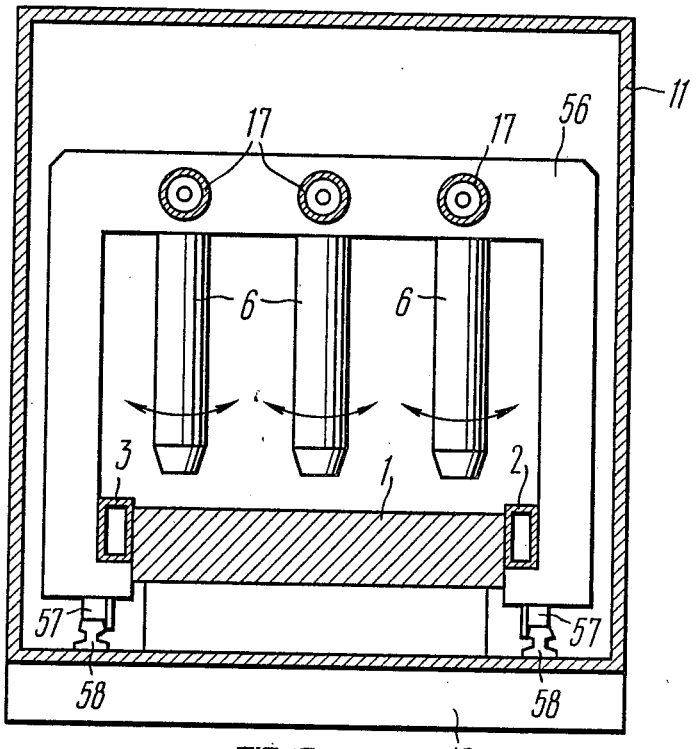
FIG. 12 is a sectional view of an apparatus of the invention taken along line XII—XII of FIG. 11.

An alternative modification of the apparatus for carrying out the method of the invention is also possible which is shown in FIGS. 11 and 12. This modification includes a gantry 56 mounted on rollers 57 for travelling along the track 58 laid within the sealed chamber 11.

Beams 2 and 3 similar to those of FIG. 9 are secured at the lower portion of the gantry 56. The upper portion of the gantry 56 is connected with the shafts 17 so as to allow the latter to rotate in the gantry 56. Thus the gantry 56, the shafts 17, the plasma torches 6, and the mold walls 2 and 3 make up an assembly capable of travelling in relation to the immovable work 1. The gantry 56 and consequently the whole assembly may be driven from any suitable translatory drive. The gantry 56 may be connected to the drive either directly or through the shafts 17 as shown in FIG. 11.

In the latter case the apparatus includes a translatory drive 46 constructed as a hydraulic cylinder 47 in a similar way as is the case in the modification previously disclosed hereinbefore and shown in FIG. 7.

As the hydraulic cylinder 47 moves in relation to the piston 48 in the direction shown by the arrow in FIG. 11, so do the shafts 17 carrying the plasma torches 6, the gantry 56, and the mold walls 2, 3 in relation to the immovable work 1. This effects movement of the metal pool along the work 1, which provides a continuous melting of the entire surface of the work.

During movement of the gantry 56 and other members associated therewith it is possible, similarly to the previous modifications, to oscillate the plasma torches 6 as shown in FIG. 12 using the hydraulic cylinder 25 (FIG. 11).

In all the modifications of the apparatus herein discussed and illustrated in FIGS. 5 through 12 the drive fior relatively moving the work 1 and the shafts 17 with the plasma torches 6 is connected with one of the members taking part in the movement, which member may be either the work 1 or the shafts 17.

It is evident that this drive may be connected with the work 1 and the shaft 17 simultaneously, and these members may be driven in opposite directions. This arrangement is a conventional feature in the art and therefore is not shown herein.

It is to be noted that any of the modifications herein described is effective in the plasma jet remelting of a defective surface layer of a work according to the method of the invention and thereby permits a high-quality work of a predetermined macrostructure of a surface layer to be produced at a higher rate of treatment.

Now by way of illustration specific Examples of carrying out the method of the plasma jet remelting through the use of the above described apparatus are given.

EXAMPLE 1

A prismatic work of a rectangular cross-section made from stainless steel and having the following dimensions (mm):

| | |
|---|---|
| length | 584 |
| width | 365 |
| thickness | 96 |

was positioned horizontally in the mold of hereinabove described apparatus and treated as prescribed by the method of the invention herein disclosed and illustrated in FIG. 1.

The work was treated under the following conditions:

| | |
|---|---|
| plasma forming gas | argon |
| number of plasma torches across the work | 8 |
| rating of each torch, kW | 40 |
| plasma torch electrode tip-to-work surface distance, mm | 40 |
| kind of current used | direct |
| plasma arc current per torch, kA | 0.48 |
| drop in voltage across the plasma arc, V | 47 to 52 |
| relative speed of the work and the plasma torches, mm/min | 34 |
| thickness of remelted surface layer, mm | 5 to 8 |

-continued

| | |
|---|---|
| time of treatment (time for initial and final stages added), min | 21 |

After the treatment defects in the initial surface layer of the work were completely removed. Post-treatment defects (cracks and porosity) characteristic for the prior art method were not detected. The work surface after treatment was slightly scored and superior in quality than that produced by roughing or grinding.

As a consequence of the remelting hydrogen content in the surface layer of the work was reduced from 0.0041 to 0.0018% by weight, while oxygen content was reduced from 0.0034 to 0.0020% by weight.

Nitrogen content in this layer gets lower but slightly, and the content of alloying elements, such as Cr and Ti, is unchanged.

In the remelted layer the crystals were oriented in parallel with the surface treated thus offering higher plastic properties of the work in the process of deformation thereof which may follow.

EXAMPLE 2

A work having the same cross-section as in Example 1 made from Fe-Ni alloy and having the following dimensions (mm):

| | |
|---|---|
| length | 563 |
| width | 268 |
| thickness | 52 |

was treated as prescribed by the method of the invention herein disclosed and illustrated in FIG. 1. Plasma torches similar to those of Example 1 were used.

The work was treated under the following conditions:

| | |
|---|---|
| plasma forming gas | mixture of argon and hydrogen |
| number of plasma torches across the work | 5 |
| kind of current used | direct |
| plasma arc current per torch, kA | 0.39 |
| drop in voltage across the plasma arc, V | 52 to 55 |
| relative speed of the work and the plasma torches, mm/min | 3 |
| thickness of remelted surface layer, mm | 7 to 9 |
| time of treatment (time for initial and final stages added), min | 197 |

Quality of the treated work and macrostructure of the surface layer thereof were similar to those described in Example 1.

In the process of remelting the content of alloying elements (Fe, Ni, Si, Mn, Ca, Mg, Ti), has not changed.

The content of gas admixtures in the remelted layer was relatively low and corresponded to said content in deeper layers of the work.

EXAMPLE 3

A work having the same cross-section as in Example 1 made of refractory alloy and having the following dimensions (mm):

| | |
|---|---|
| length | 1610 |
| width | 372 |

-continued

| | |
|---|---|
| thickness | 35 |

was treated as prescribed by the method of the invention herein disclosed using the plasma torches described in Example 1. Number of said torches was a multiple of three i.e. six.

The plasma torches were supplied from two AC sources, each of said sources supplying independently a group consisting of three plasma torches.

The work was treated in the way shown in FIG. 1, under the following conditions:

| | |
|---|---|
| plasma forming gas | mixture of argon and helium |
| kind of current used | alternating, 3-phase |
| plasma torch electrode tip--to-work surface distance, mm | |
| plasma arc current, kA: | |
| first group of torches | 0.73 to 0.76 |
| second group of torches | 0.70 to 0.74 |
| drop in voltage across the plasma arc, V: | |
| first group of torches | 68 to 72 |
| second group of torches | 70 to 75 |
| relative speed of the work and the plasma torches, mm/min | 123 |
| thickness of remelted surface layer, mm | 4 to 5 |
| time of treatment (time for initial and final stages added), min | 17 |

Quality of the treated work and macrostructure of the surface layer thereof were similar to those described in Example 1.

Chemical composition of the work has not changed in the process of remelting.

EXAMPLE 4

A work having the same cross-section as in Example 1 made from Fe-Co alloy and having the following dimensions (mm):

| | |
|---|---|
| length | 1575 |
| width | 268 |
| thickness | 50 |

was treated according to the method of the invention. In the process of the work motion, extreme torches were fixed in relation to side edges of the work while the intermediate group of torches was oscillated as shown in FIG. 4.

The work was treated under the following conditions:

| | |
|---|---|
| plasma forming gas | mixture of argon and hydrogen |
| number of plasma torches across the work | 5 |
| rating of each plasma torch, kW | 150 |
| plasma torch electrode tip-to-work surface distance, mm | 50 |
| kind of current used for supplying intermediate plasma torches | alternating 3-phase |
| plasma arc current of intermediate torches, kA | 2.6 |
| drop in voltage across plasma arcs of intermediate torches, V | 68 to 72 |
| kind of current used for supplying | direct |

-continued

| | |
|---|---|
| extreme torches | |
| plasma arc current of extreme torches, kA | 2.1 |
| drop in voltage across plasma arcs of extreme torches, V | 66 |
| frequency of oscillations of intermediate plasma torches, 1/min | 10 |
| amplitude of oscillations of intermediate plasma torches, mm | 20 |
| relative speed of the work and the plasma torches, mm/min | 275 |
| thickness of remelted surface layer, mm | 5 to 7 |
| time of treatment (time for inital and final stages added), min | 9 |

Quality of the remelted layer was similar to that specified in Example 1. Chemical composition of the layer has not changed in the process of remelting.

EXAMPLE 5

A work having the same cross-section as in Example 1 made from stainless steel and having the following dimensions (mm):

| | |
|---|---|
| length | 1295 |
| width | 301 |
| thickness | 65 |

was treated as according to the process of the invention as described in Example 4 (FIG. 4).

The work was treated under the following conditions:

| | |
|---|---|
| plasma forming gas | mixture of argon and helium |
| number of plasma torches across the work | 5 |
| kind of current used for supplying plasma arcs of intermediate torches | alternating 3-phase |
| plasama arc current of intermediate torches, kA | 2.6 |
| drop in voltage across plasma arcs of intermediate torches, V | 70 to 72 |
| kind of current used for supplying extreme torches | direct |
| plasma arc current of extreme torches, kA | 2.4 |
| drop in voltage across plasma arcs of extreme torches, V | 65 to 68 |
| frequency of oscillations of intermediate plasma torches, 1/min | 52 |
| amplitude of oscillations of intermediate plasma torches, mm | 30 |
| relative speed of the work and the plasma torches, mm/min | 342 |
| thickness of remelted layer, mm | 4 to 5 |
| time of treatment (time for inital and final stages added), min | 7 |

Quality of the remelted layer was similar to that specified in Example 1. Chemical composition of the layer has not changed in the process of remelting.

EXAMPLE 6

A prismatic work of a square cross-section made from structural steel and having the following dimensions (mm):

| | |
|---|---|
| length | 1380 |
| width | 250 |

-continued

| | |
|---|---|
| thickness | 250 |

was treated according to the method of the invention as described in Example 4 (FIG. 4).

The work was treated under the following conditions:

| | |
|---|---|
| plasma forming gas | mixture of argon and helium |
| plasma arc current of intermediate torches, kA | 2.8 |
| drop in voltage across plasma arcs of intermediate torches, V | 73 to 76 |
| plasma arc current of extreme torches, kA | 2.5 |
| drop in voltage across plasma arcs of extreme torches, V | 68 to 72 |
| frequency of oscillations of intermediate plasma torches, 1/min | 100 |
| amplitude of oscillations of intermediate plasma torches, mm | 15 |
| relative speed of the work and the plasma torches, mm/min | 500 |
| thickness of remelted layer, mm | 3 to 4 |
| time of treatment (time for initial and final stages added), min | 5 |

Quality of the remelted layer was similar to that specified in Example 1. Chemical composition of the layer has not changed in the process of remelting.

EXAMPLE 7

A work of a semi-cylindric cross-section made from titanium alloy and having the following dimensions (mm):

| | |
|---|---|
| length | 960 |
| radius of base | 158 |

was positioned horizontally and treated as prescribed by the method of the invention according to the modification shown in FIG. 3, under the following conditions:

| | |
|---|---|
| plasma forming gas | argon |
| number of plasma torches | 3 |
| plasma torch electrode tip-to-work surface distance, mm | 45 |
| kind of current used | alternating, 3-phase |
| plasma arc current of each torch, kA | 0.55 to 0.58 |
| drop in voltage across plasma arcs, V | 62 to 65 |
| amplitude of oscillations of plasma torches, mm | 34 |
| frequency of oscillations of plasma torches, 1/min | 65 |
| relative speed of the work and the plasma torches, mm/min | 102 |
| thickness of remelted surface layer, mm | 4 to 7 |
| time of treatment (time for initial and final stages added), min | 12 |

Quality, macrostructure and chemical composition of the remelted layer were similar to those specified in Example 1.

EXAMPLE 8

A work of the same cross-section as specified in Example 6 made of tool steel and having the following dimensions (mm):

| | |
|---|---|
| length | 2560 |
| width | 600 |
| thickness | 600 |

was positioned horizontally and treated as prescribed by the method of the invention in accordance with the modification shown in FIG. 4.

The treatment was carried out under the following conditions:

| | |
|---|---|
| plasma forming gas | mixture of argon and helium |
| plasma arc current of intermediate torches, kA | 2.5 |
| drop in voltage across plasma arcs of intermediate torches, V | 75 to 78 |
| plasma arc current of extreme torches, kA | 2.6 |
| drop in voltage across plasma arcs of extreme torches, V | 65 to 68 |
| frequency of oscillations of plasma torches, 1/min | 62 |
| amplitude of oscillations of plasma torches, mm | 45 |
| relative speed of the work and the plasma torches, mm/min | 86 |
| thickness of remelted layer, mm | 4 to 6 |
| time of treatment (time for initial and final stages added), min | 34 |

Quality, macrostructure and chemical composition of the remelted layer were similar to those specified in Example 1.

EXAMPLE 9

A work of the same cross-section as specified in Example 1 made of refractory alloy and having the following dimensions (mm):

| | |
|---|---|
| length | 1530 |
| width | 615 |
| thickness | 152 |

was treated according to the method of the invention. Plasma torches were similar to those specified in Example 1. Number of torches was a multiple of three i.e. nine.

All the torches were oscillated as shown in FIG. 3. Said torches were supplied from three AC sources, each of said sources supplying independently a group consisting of three plasma torches.

The treatment of the work was carried out under the following conditions:

| | |
|---|---|
| plasma forming gas | argon |
| find of current used | alternating, 3-phase |
| plasma arc current, kA: | |
| first group of torches | 0.75 to 0.78 |
| second group of torches | 0.70 to 0.72 |
| third group of torches | 0.76 to 0.77 |
| drop in voltage across plasma arcs, V: | |
| first group of torches | 60 to 65 |

-continued

| | |
|---|---|
| second group of torches | 60 to 63 |
| third group of torches | 62 to 65 |
| amplitude of oscillations of plasma torches, mm | 20 |
| frequency of oscillations of plasma torches, 1/min | 32 |
| relative speed of the work and the plasma torches mm/min | 95 |
| thickness of remelted surface layer, mm | 4 to 5 |
| time of treatment (time for initial and final stages added), min | 21 |

Quality of the treated work and macrostructure of the surface layer thereof were similar to those speciffied in Example 1. Chemical composition of the work has not changed in the process of remelting the surface layer thereof.

EXAMPLE 10

A work of the same cross-section as specified in Example 1 made from Fe-Ni alloy and having the following dimensions (mm):

| | |
|---|---|
| length | 580 |
| width | 150 |
| thickness | 45 |

was treated according to the method of the invention. The treatment was carried out with three plasma torches, said torches being similar to those described in Example 1. Extreme torches were fixed at the edges of the work while the intermediate torch was oscillated in the way shown in FIG. 4.

The treatment of the work was carried out under the following conditions:

| | |
|---|---|
| plasma forming gas | argon |
| kind of current used | direct |
| plasma arc current of all torches, kA | 0.6 to 0.8 |
| drop in voltage across plasma arcs of all torches, V | 55 to 62 |
| amplitude of oscillations of the intermediate plasma torch, mm | 45 |
| frequency of oscillations of the intermediate plasma torch, 1/min | 19 |
| relative speed of the work and the plasma torches, mm/min | 54 |
| thickness of remelted layer, mm | 6 to 8 |
| time of treatment (time for initial and final stages added), min | 14 |

Quality, macrostructure and chemical composition of the remelted layer of the work were similar to those specified in Example 1.

EXAMPLE 11

A work of the same cross-section as specified in Example 7 made from stainless steel and having the following dimensions (mm):

| | |
|---|---|
| length | 1560 |
| radius of base | 135 |

was treated with plasma torches described in Example 4 in accordance with the method of the invention as shown in FIG. 4. Extreme torches were supplied with direct current while intermediate torches were supplied with alternating current.

The treatment was carried out under the following conditions:

| | |
|---|---|
| plasma forming gas | argon |
| number of plasma torches | 5 |
| plasma arc current of intermediate torches, kA | 2.7 |
| drop in voltage across plasma arcs of intermediate torches, V | 70 to 72 |
| plasma arc current of extreme torches, kA | 2.2 |
| drop in voltage across plasma arcs of extreme torches, V | 75 to 82 |
| amplitude of oscillations of intermediate plasma torches, mm | 18 |
| frequency of oscillations of intermediate plasma torches, 1/min | 75 |
| relative speed of the work and the plasma torches, mm/min | 278 |
| thickness of remelted surface layer, mm | 5 to 7 |
| time of treatment (time for initial and final stages added), min | 8 |

Quality of the remelted layer was similar to that of Example 1. Chemical composition of the work has not changed in the process of remelting the surface layer thereof.

EXAMPLE 12

A work of the same cross-section as specified in Example 1 made of copper and having the following dimensions (mm):

| | |
|---|---|
| length | 968 |
| width | 256 |
| thickness | 55 |

was treated according to the method of the invention and to the modification shown in FIG. 4.

The treatment was carried out with plasma torches, similar to those described in Example 4, under the following conditions:

| | |
|---|---|
| plasma forming gas | mixture of argon and helium |
| plasma arc current of intermediate torches, kA | 2.1 |
| drop in voltage across plasma arcs of intermediate torches, V | 65 to 70 |
| plasma arc current of extreme torches, kA | 2.8 |
| drop in voltage across plasma arcs of extreme torches, V | 72 to 75 |
| frequency of oscillations of intermediate plasma torches, 1/min | 28 |
| amplitude of oscillations of intermediate plasma torches, mm | 23 |
| relative speed of the work and the plasma torches, mm | 123 |
| thickness of remelted surface layer, mm | 7 to 10 |
| time of treatment (time for initial and final stages added), min | 12 |

Quality of the remelted layer was similar to that of Example 1. Chemical composition of the work has not changed in the process of remelting the surface layer thereof.

EXAMPLE 13

A work of the same cross-section as specified in Example 1 made of platinum and having the following dimensions (mm):

| | |
|---|---|
| length | 304 |
| width | 200 |
| thickness | 35.4 |

was positioned horizontally in the mold of hereinabove described apparatus and treated as prescribed by the method of the invention using four plasma torches described in Example 4, according to the modification shown in FIG. 4.

The treatment of the work was carried out under the following conditions:

| | |
|---|---|
| plasma forming gas | mixture of argon and helium |
| kind of current used | direct |
| plasma arc current of extreme torches, kA | 1.2 |
| drop in voltage across plasma arc of extreme torches, V | 56 to 60 |
| plasma arc current of intermediate torches, kA | 0.90 |
| drop in voltage across plasma arcs of intermediate torches, V | 52 to 54 |
| amplitude of oscillations of intermediate plasma torches, mm | 25 |
| frequency of oscillations of intermediate plasma torches, 1/min | 38 |
| relative speed of the work and the plasma torches, mm/min | 62 |
| thickness of remelted layer, mm | 5 to 7 |
| time of treatment (time for initial and final stages added), min | 7 |

Quality of the work treated and macrostructure of the surface layer thereof were similar to those of Example 1. Chemical composition of the work has not changed in the process of remelting the surface layer thereof.

EXAMPLE 14

A work of the same cross-section as specified in Example 1 made of refractory alloy and having the following dimensions (mm):

| | |
|---|---|
| length | 460 |
| width | 150 |
| thickness | 60 |

was treated according to the method of the invention using the plasma torches described in Example 1 as shown in FIG. 1.

The treatment of the work was carried out under the following conditions:

| | |
|---|---|
| plasma forming gas | argon |
| number of plasma torches | 4 |
| kind of current used | direct |
| plasma arc current of each torch, kA | 0.62 |
| drop in voltage across plasma arc, V | 38 to 42 |
| plasma torch electrode tip-to-work surface distance, mm | 35 |
| relative speed of the work and the plasma torches, mm/min | 37 |
| thickness of remelted surface layer, mm | 6 to 7 |
| time of treatment (time for initial and final stages added), min | 15 |

Quality of the work thus treated and macrostructure of the surface layer thereof were similar to those of Example 1. Chemical composition of the work has not changed in the process of remelting the surface layer thereof.

EXAMPLE 15

A prismatic work of a trapeciform cross-section made from tool steel and having the following dimensions (mm):

| | |
|---|---|
| length | 1105 |
| width of the surface treated | 260 |
| thickness | 95 |

was treated according to the method of the invention as shown in FIG. 3.

The treatment was carried out using three plasma torches, said torches being similar to those described in Example 1, under the following conditions:

| | |
|---|---|
| plasma forming gas | argon |
| kind of current used | direct |
| plasma arc current, kA | 1.15 |
| drop in voltage across plasma arcs, V | 64 to 68 |
| amplitude of oscillations of plasma torches, mm | 42 |
| frequency of oscillations of plasma torches, 1/min | 84 |
| relative speed of the work and the plasma torches, mm/min | 98 |
| thickness of remelted layer, mm | 5 to 8 |
| time of treatment (time for initial and final stages added), min | 16 |

Quality, macrostructure and chemical composition of the remelted layer were similar to those of Example 1.

EXAMPLE 16

A work of the same cross-section as specified in Example 6 made from tool steel and having the following dimensions (mm):

| | |
|---|---|
| length | 2870 |
| width | 70 |
| thickness | 70 |

was treated according to the method of the invention using one plasma torch being similar to that of Example 4; said torch was oscillated in the way shown in FIG. 3.

The treatment was carried out under the following conditions:

| | |
|---|---|
| plasma arc current, kA | 1.3 |
| drop in voltage across plasma arc, V | 65 to 69 |
| frequency of oscillations of plasma torch, 1/min | 90 |
| amplitude of oscillations of plasma torch, mm | 25 |
| relative speed of the work and the torch, mm/min | 143 |
| thickness of remelted layer, mm | 4 to 7 |
| time of treatment (time for initial and final stages added), min | 23 |

Quality of the remelted layer was similar to that of Example 1. Chemical composition of the work has not changed in the process of remelting the surface layer thereof.

EXAMPLE 17 (NEGATIVE)

A work treated according to the method of the invention in the way described in Example 4, was turned upside-down and subjected to similar treatment of the opposite side thereof.

The treatment was carried out essentially under the same conditions. Relative speed of the work and the plasma torches was reduced below the lower recommended value (down to 2.5 mm/min) while oscillation frequency of the torches was increased above the upper recommended value (up to 120 cycles/min).

Apart from satisfactory quality of the remelted surface of the work thus treated, the time of treatment was significantly (60 times) increased and made 560 min.

EXAMPLE 18 (NEGATIVE)

A work treated according to the method of the invention in the way described in Example 6, was turned upside-down and subjected to similar treatment of the opposite side thereof.

The treatment was carried out essentially under the same conditions. The relative speed of the work and the plasma torches was increased above the upper recommended value (up to 520 mm/min), while oscillation frequency of the torches was reduced below the lower recommended value (down to 6 cycles/min).

Apart from high efficiency of the work treatment (time of treatment was 4 min), non-melted portions were present on the surface thereof thus reducing the quality of the surface treated.

INDUSTRIAL APPLICABILITY

The present invention is of particular advantage in metallurgy for treating flat works such as slabs, castings, rolled stock and forgings with the object of eliminating defects in the surface layer thereof and thus facilitating subsequent plastic deformation of these works.

While the invention has been described herein in terms of the specific examples, numerous variations and modifications may be made in the invention without departing from the spirit and scope thereof as set forth in the appended claims.

We claim:

1. A method of plasma jet remelting of a surface layer of a flat metal work having parallel side edges, said method comprising the steps of forming a metal pool on a work positioned in a mold by heating the work through the use of stabilized plasma arcs generated by plasma torches supplied with a plasma forming gas and electric current; and relatively moving the work and the plasma torches along the parallel edges of the work, characterized by the steps of horizontally arranging the work in its starting position in a mold; arranging the plasma torches over the work and over cooled mold walls in a line and across its parallel edges so that the anode spots of the extreme plasma torches in the line are confined between said edges of the work to form a metal pool extending between these edges; and, in the course of the remelting process, relatively moving the plasma torches and the work in a horizontal plane to form a remelted layer of a thickness equal to the depth of the metal pool on the whole surface of the work as the metal pool moves thereof.

2. A method as claimed in claim 1 wherein the relative speed of the work and said plasma torches in the horizontal plane is in the range from 3 to 500 mm per min.

3. A method as claimed in claim 1, characterized in that the number of said plasma torches in said line is a multiple of three and further comprising the step of applying a three-phase current to these torches.

4. A method as claimed in any of claims 1–3 characterized in that at least a part of said plasma torches of said line are oscillated in a plane orthogonal to the direction of relative movement between the work and the torches.

5. A method as claimed in claim 4, characterized in that said plasma torches are oscillated from 10 to 100 times per minute.

6. A method as claimed in claim 4, characterized in that intermediate or inner plasma torches of said line are oscillated in a plane orthogonal to the direction of relative movement, whereas extreme or end torches of the line are supplied with alternating current.

7. A method as claimed in claim 6, characterized in that the extreme or end torches of said line are supplied with direct current, while the intermediate torches of the line are supplied with alternating current.

8. A method as claimed in claim 2, characterized in that the number of said plasma torches in said line is a multiple of three and further comprising the step of applying a three-phase current to these torches.

9. A method as claimed in claim 5, characterized in that intermediate or inner plasma torches of said line are oscillated in a plane orthogonal to the direction of relative movement, whereas extreme or end torches of the line are fixed in said plane.

10. A method as claimed in claim 9, characterized in that the extreme or end torches of said line are supplied with direct current, while the intermediate torches of the line are supplied with alternating current.

11. An apparatus for plasma jet remelting of a surface layer of a flat metal work having parallel side edges, comprising a sealed chamber with a mold for receiving the work, which mold has two cooled walls lying in a horizontal plane and being parallel to one another, and plasma torches arranged within said sealed chamber and communicating with sources of a plasma forming gas, electric current, and cooling water, characterized in that the plasma torches are mounted within the sealed chamber on shafts each of which is journaled in a sealing bush installed in the wall of this chamber so that the center line of each shaft is parallel with said walls of the mold and having a drive for rotating said shafts around their axes, the apparatus being provided with a drive for relatively moving the work and the shafts in a plane parallel with said walls of the mold and along the axes of the shafts connected to at least one of the associated elements.

12. An apparatus as claimed in claim 11, characterized in that the shaft of each plasma torch has an axial bore containing supply lines of this torch.

13. An apparatus as claimed in claim 11 or 12, characterized in that the walls of the mold are secured to a truck moveably mounted within the sealed chamber, and the drive for relatively moving the work and the shafts with the plasma torches being made in the form of a translatory drive connected with this truck for simultaneously moving the beams of the mold and the work in respect to the shafts carrying the plasma torches.

14. An apparatus as claimed in claim 11 or 12, characterized in that a first drive for relatively moving the work and the shafts carrying the plasma torches is a translatory drive connected with the shafts, while the walls of the mold are fixed in respect to said sealed chamber and the work.

15. An apparatus as claimed in claim 11 or 12, characterized in that the walls of the mold are fixed in respect to the sealed chamber while said first drive for relatively moving the work and the shafts carrying said plasma torches are shaped as rollers provided with a second drive for relatively moving the same and being in contact with the work for drawing the same between the walls of the mold.

16. An apparatus as claimed in claim 11 or 12 characterized in that the shafts carrying the plasma torches and the walls of the mold are interconnected by a gantry moveably mounted within the sealed chamber, while said first drive for relatively moving the work and the shafts carrying the plasma torches is a translatory drive connected with the gantry for simultaneously moving said shafts carrying the plasma torches and the walls of the mold in respect to the work.

* * * * *